US012274930B2

(12) United States Patent
Kucharsky et al.

(10) Patent No.: US 12,274,930 B2
(45) Date of Patent: Apr. 15, 2025

(54) STITCHLESS DORSAL PADDING FOR PROTECTIVE SPORTS GLOVES AND OTHER PROTECTIVE GEAR

(71) Applicant: Wm. T. Burnett IP, LLC, Baltimore, MD (US)

(72) Inventors: David Kucharsky, Baltimore, MD (US); Patrick M. McKernan, Baltimore, MD (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 375 days.

(21) Appl. No.: 17/681,152

(22) Filed: Feb. 25, 2022

(65) Prior Publication Data

US 2022/0212087 A1 Jul. 7, 2022

Related U.S. Application Data

(63) Continuation-in-part of application No. 16/241,454, filed on Jan. 7, 2019, now abandoned, which is a continuation-in-part of application No. 14/602,915, filed on Jan. 22, 2015, now Pat. No. 10,201,744.

(60) Provisional application No. 61/930,311, filed on Jan. 22, 2014.

(51) Int. Cl.

| | |
|---|---|
| ***A63B 71/14*** | (2006.01) |
| ***A41D 13/015*** | (2006.01) |
| ***A41D 19/015*** | (2006.01) |
| *A63B 102/14* | (2015.01) |
| *A63B 102/24* | (2015.01) |

(52) U.S. Cl.

CPC ..... *A63B 71/141* (2013.01); *A41D 13/0156* (2013.01); *A41D 19/01523* (2013.01); *A41D 2600/10* (2013.01); *A63B 2102/14* (2015.10); *A63B 2102/24* (2015.10)

(58) Field of Classification Search

CPC ..... A41D 19/015; A41D 19/01517; A41D 19/01523; A63B 71/141

USPC ..... 2/169

See application file for complete search history.

(56) References Cited

U.S. PATENT DOCUMENTS

| | | | | |
|---|---|---|---|---|
| 4,570,269 | A * | 2/1986 | Berlese | A41D 27/28 D29/117.1 |
| 9,241,519 | B2 * | 1/2016 | Jaeger | A41D 19/01523 |
| 9,839,831 | B2 * | 12/2017 | Brown | A63B 71/143 |
| 10,342,274 | B2 * | 7/2019 | Lim | A41D 19/01505 |
| 2015/0047087 | A1 * | 2/2015 | Contant | A63B 71/143 2/16 |
| 2015/0143599 | A1 * | 5/2015 | Binge | A63B 71/141 2/16 |

(Continued)

*Primary Examiner* — Katherine M Moran

(74) *Attorney, Agent, or Firm* — Plumsea Law Group, LLC

(57) ABSTRACT

A protective glove can include a unitary dorsal panel formed from an inner scrim material and a plurality of protective elements molded directly to an exterior surface of the inner scrim. Two or more protective elements can be formed as an array of discrete islands each separated by substantially zero-elevation interstitial spaces. The unitary dorsal panel can be sewn or otherwise attached circumferentially to the palmer sections of the glove. This array of protective elements can provide increased protection to the user's fingers, hands, wrists, and lower forearms while maintaining flexibility and tactile feel on both palmar and dorsal sides of the glove, increasing flexibility where needed without compromising protection.

19 Claims, 7 Drawing Sheets

(56) References Cited

U.S. PATENT DOCUMENTS

| | | | | |
|---|---|---|---|---|
| 2016/0325173 | A1* | 11/2016 | Leary | A41D 19/01523 |
| 2019/0357612 | A1* | 11/2019 | Safford | A41D 19/01505 |
| 2022/0354198 | A1* | 11/2022 | Zhao | A41D 19/01523 |

* cited by examiner

STITCHLESS DORSAL PADDING FOR PROTECTIVE SPORTS GLOVES AND OTHER PROTECTIVE GEAR

CROSS-REFERENCE TO RELATED APPLICATION(S)

The present application is a continuation-in-part of application Ser. No. 16/241,454 filed 7 Jan. 2019, now abandoned, which is in turn a continuation-in-part of application Ser. No. 14/602,915 filed Jan. 22, 2015, which in turn derives priority from U.S. provisional patent application No. 61/930,311 filed Jan. 22, 2014.

BACKGROUND OF THE INVENTION

1. Field of the Invention

The present invention relates generally to padding for lacrosse gloves and other athletic apparel and accessories, and more particularly, to a protective sports glove and stitchless dorsal padding for the same that provides improved flexibility, increased protection, finer tactile feel and economy of manufacture.

2. Description of the Background

Protective sports gloves are commonly used and, indeed, are required to be used in many organized sports such as lacrosse, hockey, and other contact sports. Such gloves protect the wearer from impact of lacrosse sticks, hockey sticks, balls, pucks, skates, and other players.

Protective sports gloves include padding to protect the player's fingers, hands, wrists and lower forearms. Despite their protective function, such gloves must balance other design factors such as weight, feel and flexibility. For example, the handling of a lacrosse stick requires a player to hold and control a lacrosse stick handle in specific ways, with many different combinations of hand placement over the length of the handle. A lacrosse player constantly moves his hands along the handle in multiple positions.

In executing game skills, lacrosse players must be able to grip and control the lacrosse stick handle, i.e., "stick handling." Effective stick handling requires a player to constantly reposition his hands along the handle to control the head of the lacrosse stick. For effective stick handling, a lacrosse player needs to maintain utmost flexibility of the hand, a sure grip, and a precise tactile feel for the stick. However, the hand also needs protection and so players typically wear padded gloves to protect their hands and wrists. These gloves usually include foam padding or other protective padding covering the back of a wearer's hand, fingers, and thumb (collectively, "dorsal padding").

Some conventional sports gloves have pad segments (e.g., made of foam) that are covered with leather or synthetic leather and, in the breaks between the segments, are stitched to one another and to a liner material (also known as the scrim). The scrim may be any woven or knit fabric. In these conventional gloves individual foam pads are typically sandwiched between two fabric layers, and the layers are sewn together and to the scrim, between breaks in adjacent pads. However, this conventional construct is relatively thick and fairly rigid in design and compromises flexibility and tactile feel for protection. When such a protective athletic glove undergoes deformation due to normal use by a wearer, adjacent pads come into contact with each other and this arrests/resists further motion. In addition, the inflexibility of the fabric layers and liner resist stretching and further arrests/resists motion. In straining against these forces to maintain a grip on the lacrosse stick, a player tends to lose their tactile feel for the stick, and consequently their stick handling capability. Flexibility can be increased by larger spacing between adjacent pads, but larger spacing compromises protection of the player.

Moreover, conventional stitched dorsal padding unduly complicates the overall glove construction. The individual pads for the dorsal panel are typically sewn together, and the overlapping sewn-layers restrict flexibility. This lack of flexibility makes it very difficult to invert the glove when stitching on the palmar section (the glove is inverted when stitched interior seams are desired). The additional stitching and difficulty in manipulating the glove during manufacturing adds significant time and expense. What is needed is a protective sports glove and "unitary" dorsal panel for the same that allow for a tightly-packed pad array, yet still provides improved flexibility, increased protection, finer tactile feel, and greater economy of manufacture.

SUMMARY OF THE INVENTION

The present invention is a protective sports glove that includes a unitary dorsal panel that includes a main section configured to correspond to the back of a wearer's hand, and five finger sections each protruding from said main section, plus a substantially contiguous border flange surrounding the entire unitary dorsal panel including main section and finger sections. Each of the main section and all five finger sections bear a waffle-pattern array of foam protective pads formed as individual islands raised from a substantially zero-elevation surface. The foam protective pads are separated from each other by interstitial channels having a minimum width within a range of 1-4 mm. The substantially contiguous border flange surrounds the entire unitary dorsal panel and protrudes therefrom at a bevel angle. The glove includes a palmar section fused, welded, stitched, molded or otherwise connected to the border of the dorsal panel.

The present invention is described in greater detail in the detailed description of the invention, and the appended drawings. Additional features and advantages of the invention will be set forth in the description that follows, will be apparent from the description, or may be learned by practicing the invention.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
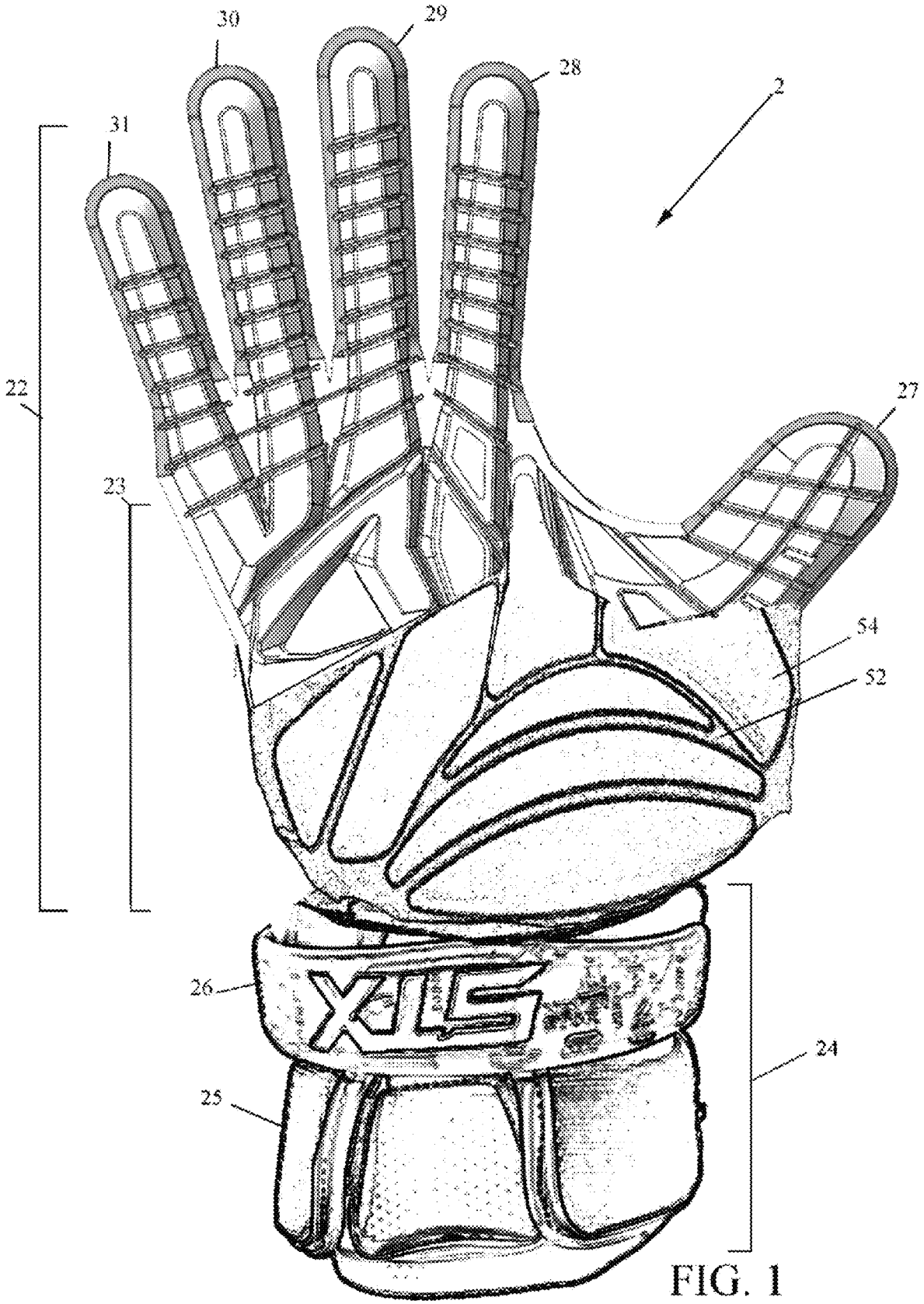
FIG. 1 is a perspective illustration of the dorsal side of a protective sports glove 2 in accordance with an embodiment of this disclosure.

The unitary padding array of embodiments of the present invention can provide advantages to address the deficiencies discussed in the background section above and may also be used for helmet liners, head gear (e.g., wrestling), other specialty gloves (e.g., baseball, boxing, biking, golf, lacrosse, equestrian, hockey, etc.), shoulder pads, knee pads, elbow pads, bicycle seats, joint supports (e.g., elbow, wrist, knee, hip, neck, shoulder and ankle), padded garments (e.g., biker shorts, etc.), joint braces (e.g., elbow, wrist, knee, hip, neck, shoulder and ankle), and other general padding and supports.

The unitary padding array is best suited for a protective glove that includes a dorsal side and a palmar side. The dorsal side includes a unitary dorsal panel formed from a molded elastomeric panel, or alternatively an inner scrim material with a plurality of protective elements molded directly to an exterior surface of the inner scrim. For purposes of this disclosure "unitary" is specifically defined to mean formed as a one-shot molded synthetic panel, or formed by a plurality of such panels integrally joined together by fusion of their synthetic material or by fusion of the foam protective pads to an underlying scrim material (e.g., RF welding, heat welding, etc.).

The plurality of protective elements can be formed in an array of discrete islands all raised from a zero-elevation surface, and each separated by interstitial spaces at substantially zero-elevation. The array of protective elements can be formed in a variety of patterns including a waffle-pattern on the main dorsal area of the hand, and a particular finger pattern as will be described that can provide increased protection to the user's fingers, hands, wrists, and lower forearms while maintaining utmost flexibility and tactile feel on both palmar and dorsal sides of the glove, increasing flexibility where needed without compromising protection. Flexibility is desired by the wearer so as to impart freedom of movement to the fingers, hand, wrists and lower forearms, which is needed to maintain an accurate tactile feel for the hand-carried lacrosse, hockey or other sports stick during a match, while protection is required to reduce injury.

The unitary dorsal panel can be fused, welded, stitched, molded or otherwise connected to the palmer sections of the glove. For example, the unitary dorsal panel can be sewn circumferentially to the palmer panel of the glove, with or without gussets and/or gusset stitching (for example, gussets are typically sewn between the dorsal and palmar sides of gloves running alongside the fingers). While the cut pattern for the palmar section may vary, an exemplary suitable cut pattern is described herein that includes three discrete panels: a finger-receiving panel; a palm panel, and a thumb panel, all sewn together to form the palmer section.

In accordance with an embodiment this disclosure, when manufacturing the glove, the palmar section can be inverted and sewn end-to-end across an inverted dorsal panel, with or without gussets. The finger-receiving section and thumb section can then be sewn on and the glove turned outside-in yielding internal seams ("inside stitching"). For this inside stitching the embodiments of this disclosure provide an additional advantage. The typical reversing out of gloves dictates a minimum gusset width, which results in a looser fit. Embodiments of this disclosure can facilitate a tighter standard for gusset width, which translates into a tighter fit. Of course, the finger-receiving section and thumb section may alternatively be sewn together exteriorly without inversion ("outside stitching").

Reference will now be made in detail to preferred embodiments of the present invention, examples of which are illustrated in the accompanying drawings. Wherever possible, the same reference numbers will be used throughout the drawings to refer to the same or like parts. Lacrosse, hockey and other stick-wielding sports gloves need to be able to flex in multiple directions freely in order for players to grip their stick and engage in necessary wrist action while still maintaining an acceptable level of protection. However, as discussed above, conventional glove design limits the amount of flex that is available to a player when they are manipulating a lacrosse or hockey stick. Specifically, conventional protective sports gloves have limited flexion and extension as well as difficult radial and ulnar deviation, and poor dorsiflexion as well. Described herein is a protective sports glove and padding for the same that can maximize flexibility without compromising protection, thereby affording more accurate tactile feel for better stick-handling.

An embodiment of the present invention provides a protective sports with a unitary dorsal panel that includes a molded pattern-array of foam protective pads closely fitted to the hand, and a palmar section stitched to the dorsal section directly or via gussets and/or gusset stitching.

With reference to FIG. 1, a first embodiment of a protective athletic glove 2 is shown which generally can include a hand receiving portion 22 covering all five digits and the carpometacarpal joints of the hand and extending down at least to the wrist crease, or further to cover all or a portion of the wrist. A lower wrist/forearm portion 24 can extend down from the hand receiving portion 22 by a distance from one to three inches. Glove 2 inclusive of both hand receiving portion 22 and lower wrist/forearm portion 24 can have both a palmar side (obscured) and a dorsal side (shown). The junction of the hand receiving portion 22 and lower wrist/forearm portion 24 can be partially encircled by a cuff inclusive of a wrist cushion 25 that partially surrounds the dorsal side and an adjustable collar 26 that extends below the hand receiving portion 22 and which may be tightened across the palmar side by hook-and-loop pads. The hand receiving portion 22 can further include a first (little finger) receiving portion 31, second (ring finger) receiving portion 30, third (middle finger) receiving portion 29, fourth (index finger) receiving portion 28, and a fifth (thumb) receiving portion 27.

The entire back of the hand receiving portion 22 inclusive of finger and thumb receiving portions 27-31, as well as the entire dorsal side down to the lower wrist/forearm portion 24 comprises a unitary dorsal panel 40 having an array of foam protective pads 54 formed as individual islands raised from a substantially zero-elevation surface 52. Foam protective pads 54 can be integrally-molded or fused to the substantially zero-elevation surface 52 such that interstitial channels of minimal substrate thickness are formed between the discrete pads 54. Unitary dorsal panel 40 includes a main section 23 that extends from finger receiving portions 27-31 downward and generally corresponds to the back of the hand, and five finger sections corresponding to finger receiving portions 27-31.

Figure 2:
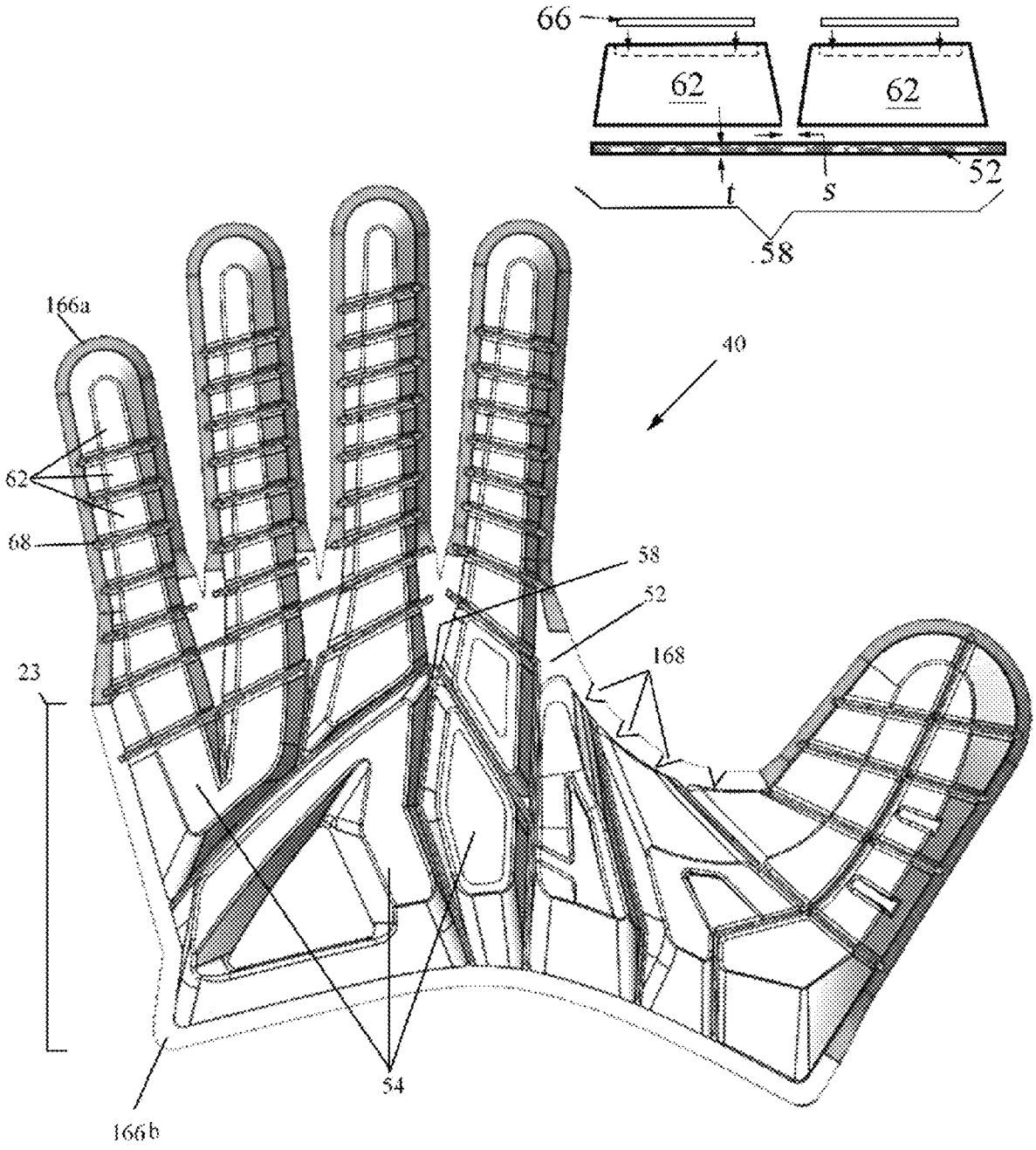
FIG. 2 illustrates the unitary dorsal panel pattern on the dorsal section of glove 2 for the embodiment of FIG. 1.

In the embodiment of FIG. 2 the zero-elevation surface 52 can include a molded baseline layer or a thin pliable layer of any suitable scrim material, and the array of discrete pads 54 extend upward from the zero-elevation surface 52. The scrim material may be any pliable textile or synthetic sheet material including natural or synthetic fabric, and may optionally be porous and/or stretchable. Suitable materials for the scrim material include polyester, cotton, and nylon. The scrim material of zero-elevation surface 52 may be woven from warp and weft threads which provide mesh openings or interstices between the threads. However, other scrim materials, such as, for example, perforated fabric, can also be used so long as the scrim material permits the pads 54 to bond with or adhere to the scrim material.

The scrim material may or may not have a limited stretch characteristic to it. Toward this end scrim material may be cut from a knitted/woven stretchable fabric blank comprising a material formed from a combination of first yarn strand(s) made of synthetic fibers, and a second elastomeric stretchable yarn strand. The first yarn strands can be knitted/woven together with the elastomeric second strand to create a single blank of woven/knitted fabric. The knitted/woven blank can have a specific fiber content vis-à-vis the combination of the two strands of yarn used. The first yarn strands may be 100% polyester, which is the dominant fiber of the fabric blank. As an alternative to polyester, the first yarn strands may comprise nylon. The second elastomeric yarn strand may be comprised of any elastic textile fiber, however, it is preferred that this material be made of the elastomeric textile fiber known as spandex. Specifically, the knitted/scrim material may comprise a blend of polyester or poly-cotton yarn and spandex, wherein the spandex fiber content is constrained to within an acceptable range of from 3 to 15%, and most preferably is 6%. This may be achieved with a knit/weave ratio of synthetic yarn/spandex yarn of from 33:1 to 20:1, and identical deniers. One skilled in the art will understand that the variation between fabric blends may also be made possible by varying the ratio of yarns and the structure of the knit or weave pattern.

The array of integral pads 54 can be formed on the unitary dorsal panel 40 by molding/fusing/adhering them into the scrim fabric. The array of integral pads 54 formed on the unitary dorsal panel 40 can be formed integrally on zero-elevation surface 52 by a process of sonic Radio Frequency ("RF") welding as described below in Example 1. Alternatively, the array of integral pads 54 may be formed on the unitary dorsal panel by a process of compression molding as described below in Example 2 or may be individually attached to the scrim material by adhesive. In either case the foam protective pads 54 comprise rubber and/or foam, most preferably open-cell or closed-cell foam rubber blocks fused or integrally-molded to the scrim material by molding, casting or other suitable fusion method. The pads 54 are raised as discrete islands separated from each other by interstitial channels 58 flush with zero-elevation surface 52.

The particular pattern of foam protective pads 54 can be designed to provide increased protection to the dorsal side of the user's fingers and hands while maintaining as much flexibility within the glove and tactile feel as possible. Flexibility is desired by the wearer so as to impart freedom of movement to the fingers, hand, wrists and lower forearms needed to properly participate in lacrosse, hockey or other sports matches while protection is required to reduce injury. A variety of pads 54 occupy the dorsal panel 40 in the main section 23 beneath the finger receiving portions 28-31 and these can also be welded or otherwise attached to the liner scrim beneath. Any suitable geometry of foam protective pads 54 may be provided to optimize both protection and flexibility. For example, foam protective pads 54 on the main section 23 of dorsal panel 40 can be arranged in a waffle-pattern array, with various shapes including crescents, triangles, etc. In the illustrated embodiment the shock absorbing foam protective pads 54 are generally shaped as blocks and most preferably a trapezoidal prism, while some proximate the wrist crease are shaped as crescents. The particular shapes of the pads 54 may be altered to promote specific performance improvements.

On the other hand, each of the finger receiving portions 27-31 bears a particular pattern of foam protective pads 62 designed to optimize flexibility as will be described. The geometry of foam protective pads 62 is more specific to optimize protection and flexibility as described below.

Comfort is also important and toward this end venting may be provided through the scrim material between the discrete pads 54. Specifically, said scrim material may include one or more pass-through vents between the discrete pads 54 for improved air circulation.

As seen in FIG. 2 the dorsal panel 40 along each of the finger receiving portions 28-31 and thumb receiving portion 27 bears a plurality of foam protective pads 62 different from other pads 54, and spaced by interstitial channels 68 different from other channels 58. The finger pads 62 are all formed with a trapezoidal cross-section and aligned end-to-end and spaced very closely: the interstitial channel spacing s between the discrete pads 62 is within a range of from 1-4 mm and most preferably approximately 1 mm. In addition, the 1 mm interstitial channels 68 are recessed below the zero-elevation surface to provide additional flexibility between the cushions when a wearer's fingers are bent. The faces of opposing pads 62 on either side of the interstitial channels can be inclined at an obtuse angle to allow a limited degree of counter-arching of the fingers, but eventually make contact to prevent over-arching.

All foam protective pads 54, 62 are generally made of a discrete block of any suitable protective material such as micro-cellular foam, preferably open cell, urethane foam (e.g., Poron™, PVC nitrile foam, or another suitable impact-absorbing closed cell foam material). The interstitial channels 58, 68 can be of substantially minimal substrate thickness and substantially minimal spacing between the discrete pads 54, 62. The interstitial channels 58, 68 effectively form flexible hinges between the discrete pads 54. This is best seen in the inset of FIG. 2. Specifically, the thickness of the scrim t at the interstitial channels 58 is preferably on the order of 0.1-4.0 mm and is most preferably approximately 0.4 mm. If desired, a very thin layer of Ethylene-vinyl acetate ("EVA") foam may be added to the back (lower) side of the scrim material 52, or other suitable adhesion promoter, to improve adhesion of the discrete pads 54, 62 (see FIG. 2 inset) on the front (upper) side of scrim material 52. Discrete pads 54, 62 can be preferably molded EVA foam blocks ranging from 9 mm to 13 mm in thickness. Thus, as an example, the layers in the illustrated embodiment can comprise (moving from hand to outside of glove):

i. Layer 1—optional thin layer of EVA adhered to scrim material 52 (1 mm preferred)

ii. Layer 2—scrim material 52 (0.1-4.0 mm thickness, 0.4 mm preferred);

iii. Layer 3—Discrete EVA pads 54 ranging from 9 mm to 13 mm thickness.

In main section 23 the interstitial channel spacing s between the discrete pads 54 is preferably on the order of 0.5-5.0 mm, more preferably 1.0-4.0 mm, and is most preferably approximately 2 mm. If desired, optional hard shell tiles 66 formed of polyethylene, Nylon or other suitable impact-resistant material may be inset/adhered or otherwise formed in the top surface of each discrete pad 54 to add impact resistance.

Referring back to FIG. 1 the lower wrist/forearm portion 24 is defined by a cuff attached below the hand receiving portion 22, the cuff can include a wrist cushion 25 that partially surrounds the dorsal side and an adjustable collar 26 that extends below the wrist cushion 25 and which may be tightened across the palmar side by hook-and-loop pads, or alternatively by traditional string lacing for wrist cuff closure.

The pad 54, 62 array can be molded onto a square blank of scrim material 52 and the blank may be cut (die, laser, rotary-blade, water-jet, etc.) using an outline cut that results in a substantially contiguous border flange 166 framing the entire dorsal panel 40, resulting in the dorsal panel as shown in FIG. 2. As best seen in FIG. 2 the border flange 166 substantially surrounds the entire dorsal panel including main section and all five finger sections and is preferably within a range of from 2-8 mm across, and most preferably a 5-6 mm margin. Given border flange 166, the palmar section including palmar section 192 can be fused, welded, stitched, molded or otherwise connected to the border flange 166 around all four of the finger receiving portions 28, 29, 30 and 31, and thumb 27. The border flange 166 may be a uniform-thickness flat strip but may optionally have non-uniform features for maximum flexibility. For example, for maximum flexibility the border flange 166 in the crease between one opposing finger sections 27, 28, 29, 30 and 31 can include a series of V-notch slits 168 for flexibility.

Figure 4:
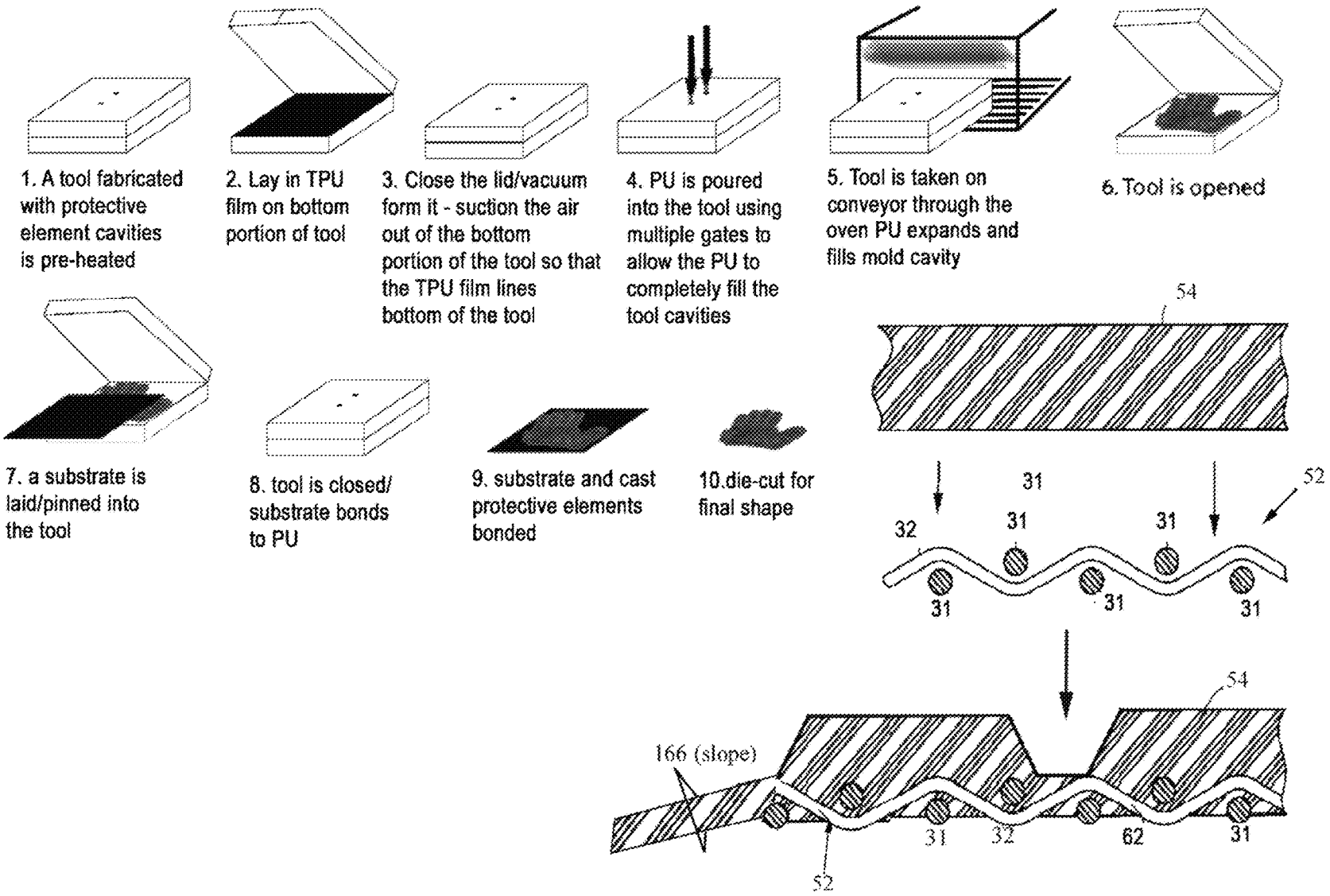
FIG. 4 is a process drawing illustrating the process for making a dorsal section of glove 2 for the embodiment of FIG. 1 by textile reinforced compression molding.

Importantly, the border flange 166 surrounding the five finger-receiving sections 27, 28, 29, 30 and 31 is formed with a bevel, e.g., the border flange 166 is angled rearward (away from the picture in FIG. 2). This bevel is configured to avoid interference between the border flange 166 of adjacent finger-receiving sections 28, 29, 30 and 31. Preferably, the border flange 166 is sloped, beveled or tapered away at a slope relative to the zero-elevation surface as shown in FIG. 4 (bottom) around all of the finger-receiving sections 28, 29, 30, 31. However, while the preferred embodiment employs the bevel around all of the finger-receiving sections 28, 29, 30, 31, the purpose of the disclosure may be substantially accomplished with a border flange 166 around any two adjacent finger-receiving sections. Around the finger sections the bevel angle from the zero-elevation surface 52 is an acute angle within a range of from 30-60 degrees, and the border flange 166 may protrude parallel to the zero-elevation surface elsewhere. In the embodiment shown in FIG. 2 a first (grey-shaded) section 166*a* of the border flange 166 surrounding four fingers protrudes at the acute bevel angle from the zero-elevation surface, and a second (grey-shaded) section surrounding the thumb protrudes at the same acute bevel angle from the zero-elevation surface. All other sections 166*b* of the border flange 166 (not grey shaded) protrude horizontal to the zero-elevation surface 54.

This bevel between adjacent finger sections minimizes resistance as described below in regard to FIG. 9, and also helps with the inverted assembly described above. The glove 2 can have inverted seams in normal use, meaning the border flange 166 can be tucked under the palmar section 192 and the latter is stitched thereto around at least a portion of all four of the finger receiving portions 28, 29, 30, 31 and thumb 27.

As seen in FIG. 4, the scrim material 52, 152 may again be any pliable textile or synthetic sheet material including natural or synthetic fabric and may optionally be woven from warp and weft threads 31 and 32 which provide mesh openings or interstices 33 between the threads 31 and 32. Optionally, perforated or needle punched fabric can also be used so that the fabric is provided with openings which permit the rubber and/or foam to interlock with the fabric. Suitable materials for the fabric can include polyester, cotton, and nylon.

As detailed below in Example 1 sonic welding can cause the rubber/foam to fuse to the scrim material, and where the scrim material is perforated or woven it can flow into the mesh openings of the textile scrim fabric 52, 152 and mechanically interlocks with the fabric. The fabric can reinforce the rubber/foam, strengthen the rubber/foam especially in the interstitial areas, and reduce the possibility that the dorsal shell will tear.

Example 1: Sonic-Welded Dorsal Panel

Figure 3:
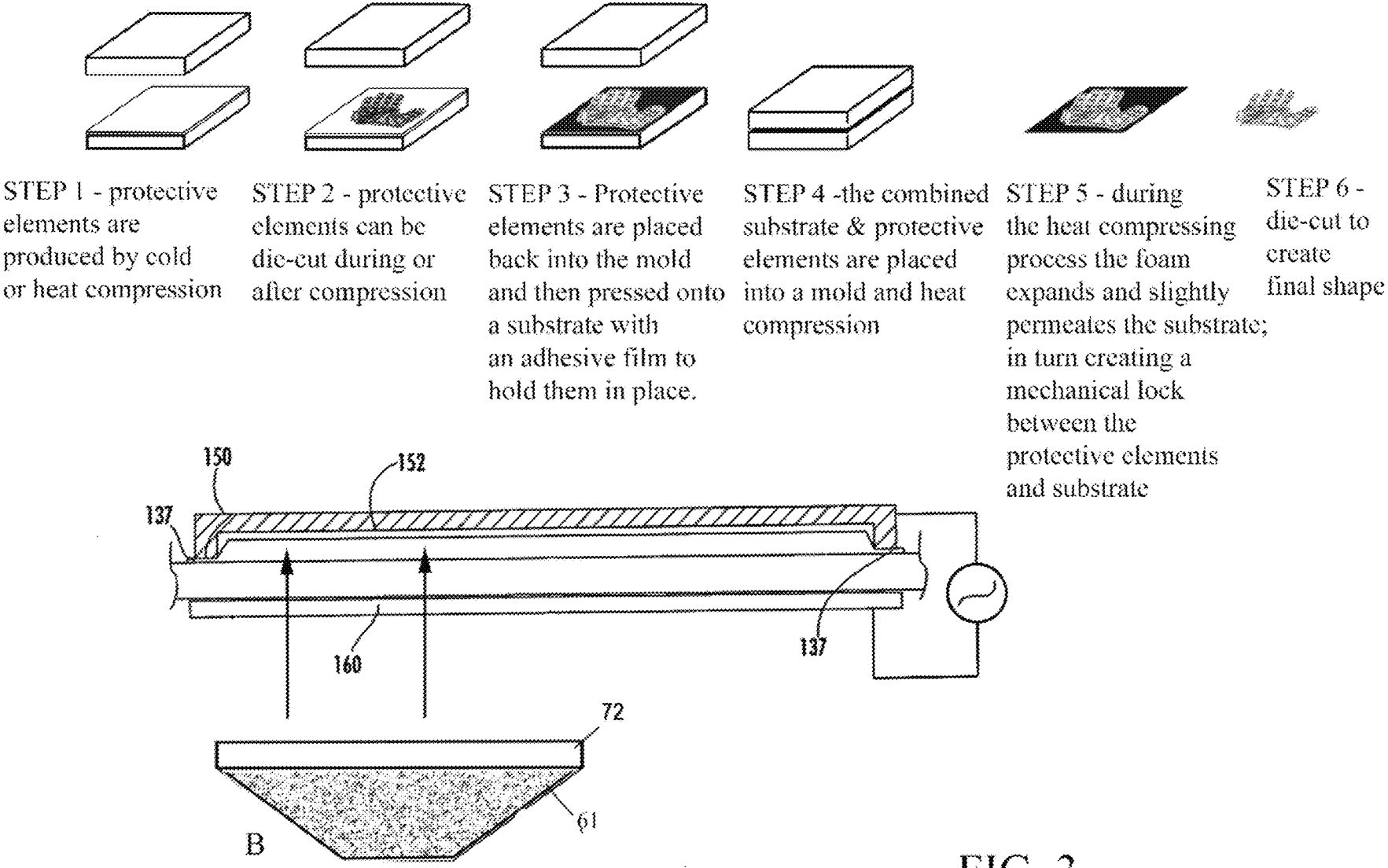
FIG. 3 is a process drawing illustrating the process for making a dorsal section of glove 2 for the embodiment of FIG. 1 by compression molding.

FIG. 3 is a process drawing illustrating an exemplary process for making a dorsal section of glove 2 for the embodiment of FIG. 1. Initially, at Step 1 the entire array of foam protective pads 54, 62 can be produced by either cold or heat compression in a tool, for example, cast-in-place by pour-casting into a two-part mold. At step 2, the foam protective pads 54, 62 can be die-cut either post compression or during compression to attain their finished form. As seen at Step 3 the foam protective pads 54, 62 can be placed back into the tool/mold and pressed onto a substrate using an adhesive film laid overtop pads 54, 62 to keep them registered. As seen at Step 4, the combined film, substrate and foam protective pads 54, 62 can be placed into a flatbed high frequency welding station 100 as seen at B. To perform HF welding, two opposing die platens 150, 160 can act as capacitor plates. An oscillating electrical current can be applied to the mold 72/fabric blank 61 combination between the die platens 150, 160. The oscillating electrical field in conjunction with capacitive platens 150, 160 can convert the oscillating electrical current into an oscillating electric field that is applied to the mold 72/fabric blank 61 combination. The die platens 150, 160 may comprise brass, steel, aluminum/magnesium, or other similar materials. To perform the weld, the die platens 150, 160 can be compressed together and the ultrasonic field and combined pressure can cause localized melting of the foam protective pads 54, 62 only at the interface of the scrim fabric and the foam protective pads 54, 62, resulting in fusing of the pads 54, 62 to the scrim fabric. As shown at Step 5, during the heat compressing process, the foam of the foam protective pads 54, 62 can expand and, with a porous substrate, can slightly permeate the substrate, flowing into the mesh openings of the textile scrim fabric 52, 152 and mechanically interlocking with the fabric, creating a unitary bond between the foam protective pads 54, 62 and substrate. If the substrate is not porous substrate, during the heat compressing process, the foam of the protective elements can fuse/adhere to the scrim substrate. The net result is a dorsal panel as illustrated in FIG. 3. At Step 6 the dorsal panel 40 can be die cut to the desired shape.

In yet another embodiment, a unitary dorsal section 40 of glove 2 for the embodiment of FIG. 1 can be created using a plurality of independent scrim sections by fusing foam protective pads 54, 62 via the sonic welding process of FIG. 3 across the multiple sections of scrim material 52 to bridge them, effectively fusing them together.

Example 2: Textile Reinforced Compression Molded Foam Rubber Dorsal Panel

FIG. 4 is a process drawing illustrating an alternative process for making a dorsal section of glove 2 for the embodiment of FIG. 2. Initially, at Step 1*a* mold fabricated with protective element cavities can be pre-heated. At Step 2 an optional thermoplastic polyurethane (TPU) film can be laid on the bottom portion of the mold. One skilled in the art should understand that the TPU film may be omitted to reduce manufacturing cost. At Step 3 the mold can be closed and dorsal panel 40 of glove 2 can be vacuum formed by releasing the air out of the bottom portion of the tool/mold so that the TPU film lines the bottom of the tool. At step 4 polyurethane can be poured into the tool/mold using multiple gates, to allow the polyurethane to completely fill the tool cavities. At Step 5 the tool can be put on a conveyer through an oven. The polyurethane can thermally expand to fill the tool/mold cavities. At Step 6 the tool can be opened, and at Step 7 a substrate can be laid or pinned into the tool. The substrate may be a rubber and/or foam sheet. At Step 8 the tool can be closed and the rubber/foam 66 softens and/or becomes fluid in the mold and as a result of compression flows out of the interstitial channels and into the pad sections, also flowing into the pores of the scrim material 52 and around the threads as illustrated in FIG. 4 C. The rubber/foam 54, 62 thereby can form a mechanical interlock or bond with the scrim material 52. When the rubber/foam cools, the fabric can be integrated with the rubber/foam.

Moreover, the heat and pressure of molding displaces the rubber/foam into the mold cavities and can define the substantially zero-elevation interstitial surfaces 52 surrounding the array of raised pads 54, 62, each pad forming a raised island on the substantially zero-elevation surface 52. The scrim material 52 strengthens and reinforces the rubber/foam 66. If desired, the foam rubber 54, 62/scrim 52 combination can be molded into a particular shape. For example, the dorsal panel 40 can be provided with a preformed arch to conform to the back of the hand.

The textile reinforced zero-elevation interstitial hinges 58, 68 can increase flexibility without compromising protection, thereby affording more accurate tactile feel for better stick handling. The unitary (stitchless) dorsal panels 40 can also substantially reduce manufacturing time and expense. Either embodiment of the unitary dorsal panel 40 may be sewn or otherwise attached circumferentially to the palmer sections of the glove.

Figure 5:
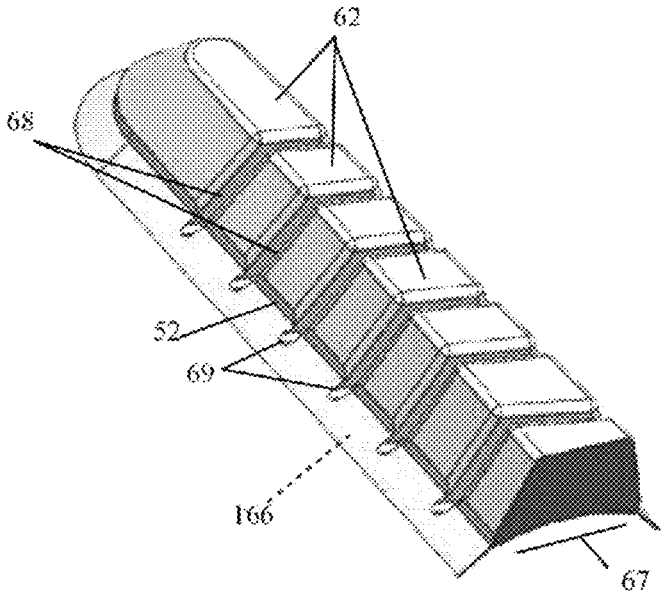
FIG. 5 is a perspective view illustrating an exemplary pattern for any of the finger receiving portions 27-31.

FIG. 5 is a perspective view illustrating an exemplary pad pattern for any/all of the finger receiving portions 27-31. As indicated above, foam protective pads 62 along each of the finger receiving portions 28-31 are all formed with a trapezoidal cross-section along a majority of their lengths, all aligned end-to-end, and spaced very closely. The interstitial channel 68 spacing s between the discrete pads 62 is within a range of from 1-4 mm and most preferably approximately 1 mm. In addition, the interstitial channels 68 are recessed below the zero-elevation surface 52 by angled notches 69 that partially undercut the pads 62. Notches 69 are continuations of interstitial channels 68, but are non-parallel thereto. Instead they dip below the zero-elevation surface 52 and angle rearward undercutting the adjacent pad 62, extending total distance within a range of from 1-4 mm and most preferably approximately 1 mm below the zero-elevation surface. In addition, notches 69 extend sideward beyond the adjacent pads 62, traversing the pads 62 and extending slightly into the border flanges 166 for maximum flexibility. The faces of opposing pads 62 on either side of the interstitial channels 68 can be inclined at an obtuse angle (relative to zero-elevation surface 52 to allow a limited degree of counter-arching of the fingers, but eventually make contact to prevent over-arching. Also note that the undersides 67 of pads 62 are arched from side-to-side to conform to the arch of the fingers, thereby enhancing comfort. The undersides 67 of pads 62 transitions directly into the border flange 166 on both sides of each finger at the same angle.

Figure 6:
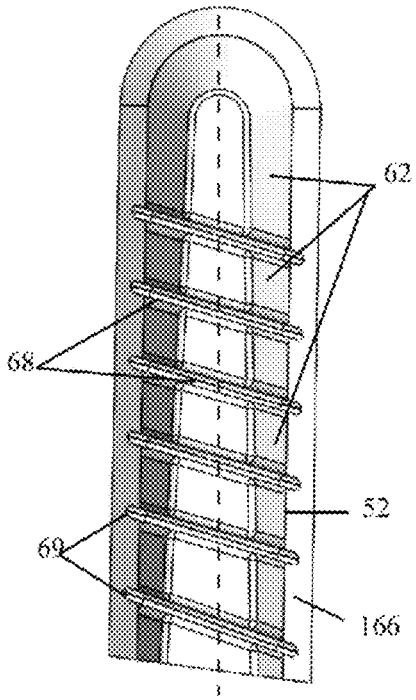
FIG. 6 is a top view of the dorsal panel 40 along finger receiving portions 27-31.

FIG. 6 is a top view of the dorsal panel 40 along finger receiving portions 27-31. The interstitial channels 68 and notches 69 are parallel-aligned along a slanted "accordion" pattern within a range of a 20-to-30 degree angle relative to the lengthwise finger axis.

Figure 7:
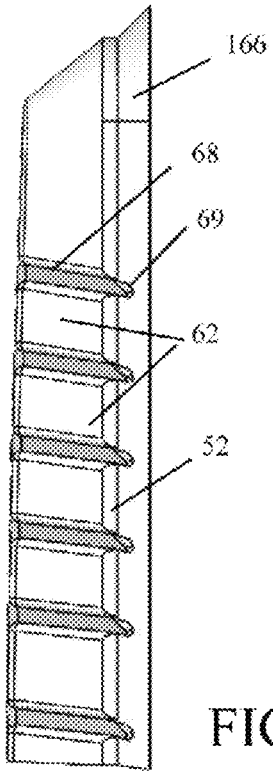
FIG. 7 is a side view of the dorsal panel 40 along finger receiving portions 27-31.
Figure 8:
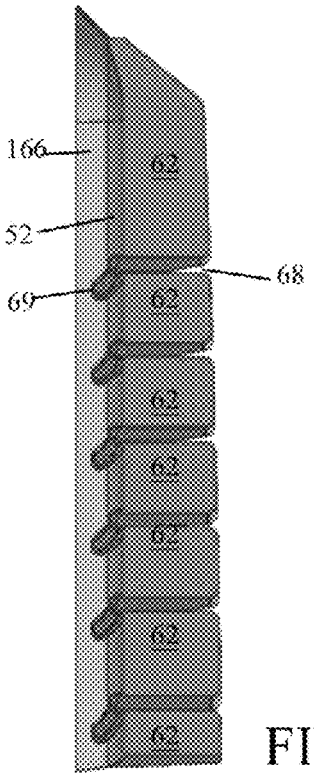
FIG. 8 is a section view of the dorsal panel 40 along finger receiving portions 27-31 taken along the dotted line A-A' of FIG. 6.

FIG. 7 is a side view of the dorsal panel 40 along finger receiving portions 27-31, and FIG. 8 is a section view taken along the dotted line A-A' of FIG. 6. The interstitial channels 68 run vertically between pads 62 relative to the zero-elevation surface 52, but the notches 69 extend further than the interstitial channels 68 into the border flanges 166, and cut at an angle slightly beneath the adjacent pad 62, thereby interrupting their footing/foundation and further increasing flexibility.

Figure 9:
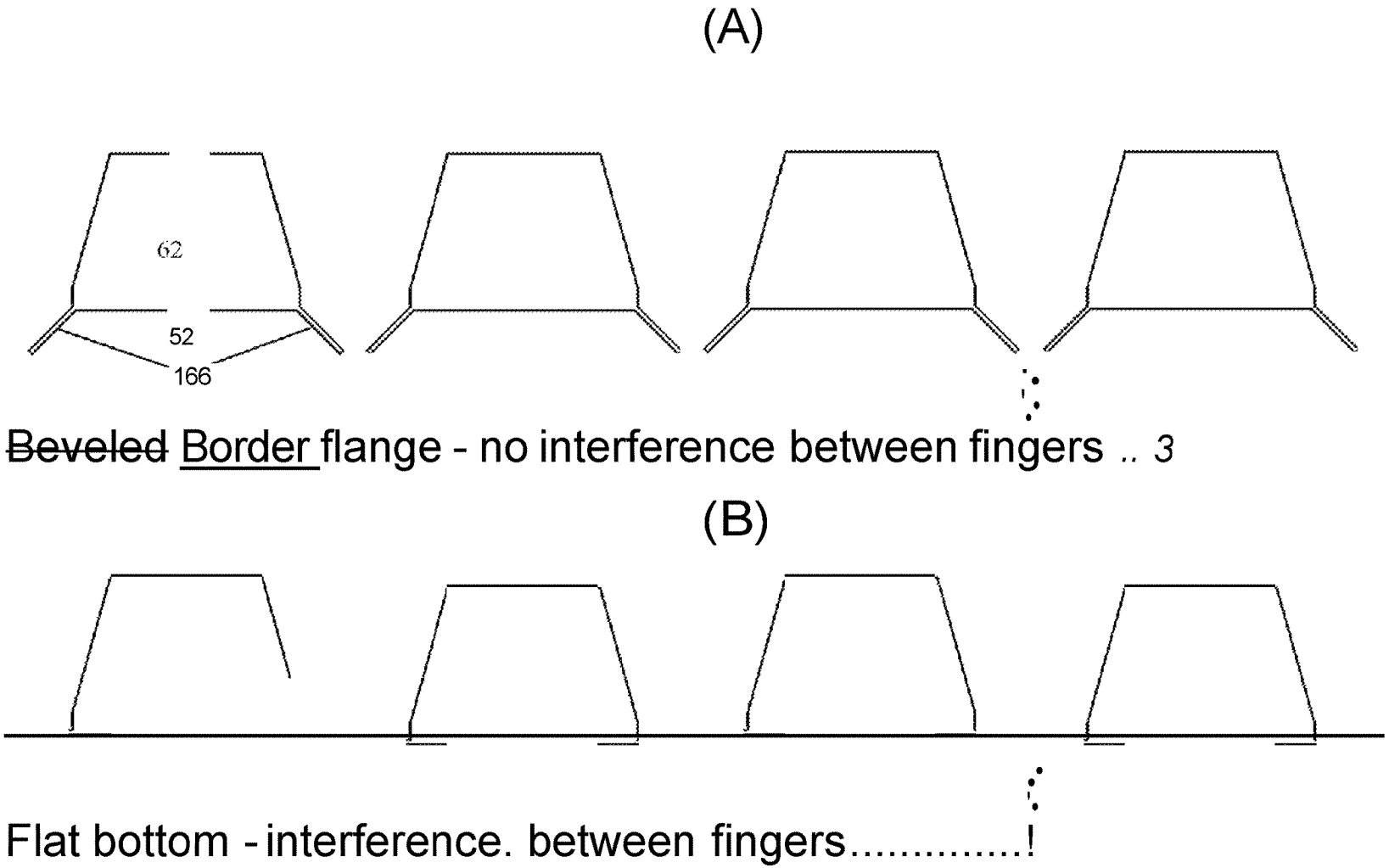
FIG. 9 is a diagrammatic view of the dorsal panel 40 along finger receiving portion illustrating how the border flanges 166 at top (A) avoid finger-interference while flat flanges at bottom (B) cause interference.

FIG. 9 is a diagrammatic view of the dorsal panel 40 along finger receiving portions 27-31 illustrating border flanges 166 at top (A) protruding downward at a natural 60 degree angle relative to zero-elevation surface avoid finger-interference. The border flanges 166 as at top (A) are highly resilient, and when adjacent fingers compress together the border flanges 166 simply flex to accommodate, impart no resistance, and greatly reducing side-to-side finger-interference and accompanying false tactile sensations. Conversely, flat horizontal flanges at bottom (B) parallel encounter each other head-on and resist flexing when adjacent fingers compress together. Non-beveled flanges resist flexing, increase side-to-side finger-interference and contribute to false tactile sensations that derogate from the player's touch and game play.

Figure 10:
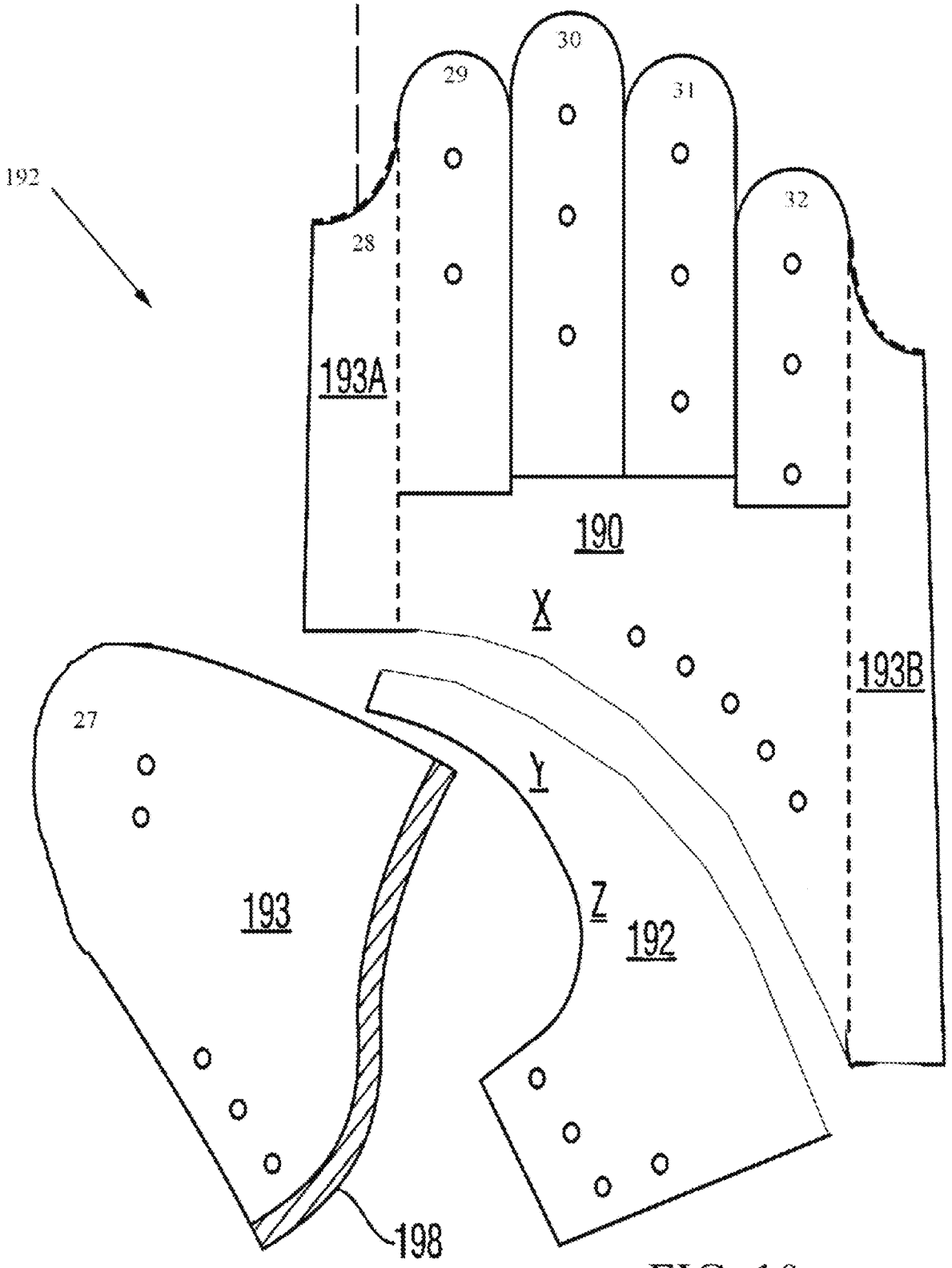
FIG. 10 is a pattern view of the palmar section 192 including three panels cut from a blank.

FIG. 10 is a pattern view of the palmar section 192, which may be cut from a blank to define three distinct panels including finger panel 190 including four of the finger receiving portions 28, 29 but not thumb 30. On both sides of the finger-receiving section 190 a protruding margin may be formed 193A, 193B. One skilled in the art should understand that margins 193A, 193B may be convenient for stitching but are non-essential and may be eliminated as a matter of design choice. The margin 193A protrudes outward beginning at the distal phalangeal joint of the index finger-receiving portion 28 and increasingly protrudes outward ending at the metacarpophalangeal joint. The margin 193B protrudes outward beginning at the distal phalangeal joint of the little finger-receiving portion 32 and increasingly protrudes outward ending at the base of the little finger metacarpals bone. In addition, a palm panel 192 is sewn to finger panel 190 as shown, and a thumb panel 193 is sewn to the palm panel 192 along margin 198.

For assembly, the finger-receiving section 190 can be frequently inverted and stitched to the inverted dorsal panel 40, 140 by seams, for example, through facing margins 193A, 193B and the margins surrounding dorsal panel 40, 140. The X/Y interface shown in FIG. 7 is not sewn. The palm section 192 is sewn to the inverted finger-receiving section 190 at the X/Y interface. Thumb section 193 is rolled and stitched into a receptacle, and is inverted. The combined finger-receiving section 190 and dorsal section 40, 140, still inverted, is sewn to the still-inverted thumb section 193. The entire assembly is re-inverted to produce the final glove 2, 12 with interior seams.

Since the dorsal panel 40 has highly-flexible interstitial hinges (rather than overlying layers where pads are sewn together, where overlapping sewn-layers restrict flexibility), the combined finger-receiving section 190 and dorsal section 40 are much easier to invert manually. The additional flexibility makes it possible to quickly invert the glove 2 when stitching on the palmar section and saves significant time and expense.

It should now be apparent that the above-described protective sports glove 2 with unitary stitchless dorsal panel 40 allows a user to flex the hand in all directions freely, to grip a lacrosse, hockey or other type of sports stick, and to maintain accurate tactile feel at every necessary wrist inclination, all while maintaining a suitable level of protection. The glove 2 allows freer flexion and extension, as well as radial and ulnar deviation, and dorsiflexion.

Variations and modifications of the embodiments described herein are considered within the scope and spirit of the invention. For example, the unitary dorsal padding array of the present invention may be inserted in compressed or uncompressed form within a pocket formed in the scrim material on the dorsal side of the glove 2. Such pocket would allow for easier construction, reducing labor costs, and may be better suited for an intermediate level of play. The pocket circumferential edges may be sewn to the palm and fingers with one side of the pocket left open to insert and receive the compressed dorsal panel.

The unitary dorsal padding array of the present invention provides these advantages and may also be used for helmet liners, head gear (e.g., wrestling), other specialty gloves (e.g., baseball, boxing, biking, golf, lacrosse, equestrian, hockey, etc.), shoulder pads, knee pads, elbow pads, bicycle seats, joint supports (e.g., elbow, wrist, knee, hip, neck, shoulder and ankle), padded garments (e.g., biker shorts, etc.), joint braces (e.g., elbow, wrist, knee, hip, neck, shoulder and ankle), and other general padding and supports.

For the purposes of this disclosure, unless expressly stated otherwise: (a) the use of singular forms of terms include plural forms; (b) the use of the terms "including," "having," and similar terms are deemed to have the same meaning as "comprising" and thus should not be understood as limiting; (c) the term "set" or "subset" means a collection of one or more than one elements; (d) the term "plurality" means a collection of two or more elements; (e) the term "such as" means for example; (f) the term "and/or" means any combination or sub-combination of a set of stated possibilities, for example, "A, B, and/or C," means any of: "A," "B," "C," "AB," "AC," or "ABC;" and (g) headings, numbering, bullets, or other structuring of the text of this disclosure is not to be understood to limit or otherwise affect the meaning of the contents of this disclosure.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A protective sports glove having a palmar section configured for covering a wearer's palm, the protective sports glove comprising:

a unitary dorsal panel configured to attach to the palmar section and cover the back of said wearer's hand including at least four fingers, the dorsal panel consisting of an integrally-molded elastomeric member formed with a main section and adjacent finger sections sharing a common zero-elevation surface and a patterned array of foam protective pads each defining an individual island raised from said zero-elevation surface, said patterned array of foam protective pads including a plurality of foam protective pads extending along each finger section, the foam protective pads within each finger section being aligned end-to-end and separated from adjacent foam protective pads by interstitial channels having a width within a range of from 1-4 mm, and a border flange circumscribing said finger sections of said dorsal panel, said border flange protruding outward from said zero-elevation surface around said finger sections, and protruding outward at an acute bevel angle relative to said zero-elevation surface around at least four of said adjacent finger sections.

2. The protective sports glove according to claim 1, wherein said interstitial channels have a width of approximately 2 mm.

3. The protective sports glove according to claim 2, wherein a second section of said border flange protrudes parallel to said zero-elevation surface.

4. The protective sports glove according to claim 1, wherein the first section of said border flange protrudes at an acute bevel angle within a range of from 30-60 degrees relative to said zero-elevation surface.

5. The protective sports glove according to claim 1, wherein all of the foam protective pads along at least four finger sections of said wearer's hand comprise non-parallel sides.

6. The protective sports glove according to claim 5, wherein all of the foam protective pads along at least four finger sections of said wearer's hand comprise a trapezoidal cross-section.

7. The protective sports glove according to claim 6, wherein all of foam protective pads having the trapezoidal cross-section have an arched base configured to conform to a finger.

8. The protective sports glove according to claim 1, wherein all of the interstitial channels are configured to extend over at least four fingers of said wearer's hand and are parallel-aligned along a slant pattern.

9. The protective sports glove according to claim 8, wherein said slant pattern comprises a slant angle within a range of a 20-to-30 degrees relative to a lengthwise finger axis of the protective sports glove.

10. The protective sports glove according to claim 1, wherein said border flange has a width within a range of 4-8 mm.

11. The protective sports glove according to claim 1, further comprising a series of V-notches in said border flange for flexibility.

12. The protective sports glove according to claim 1, wherein said patterned array of foam protective pads includes crescent shapes.

13. The protective sports glove according to claim 1, wherein said dorsal panel is fused to a layer of mesh scrim material.

14. The protective sports glove according to claim 1, further comprising a lower wrist/forearm portion extending below said unitary dorsal panel with an attachment strap configured to secure said lower wrist/forearm portion around said user's forearm below the wrist.

15. The protective sports glove according to claim 1, wherein said dorsal panel is molded of ethylene-vinyl acetate foam.

16. A protective sports glove having a palmar section configured for covering a wearer's palm, the protective sports glove comprising: a unitary dorsal panel configured to attach to the palmar section and cover the back of said wearer's hand including at least four fingers, the dorsal panel consisting of an integrally-molded elastomeric member formed with a main section and adjacent finger sections sharing a common zero-elevation surface and a patterned array of foam protective pads each defining an individual island raised from said zero-elevation surface, said patterned array of foam protective pads including a plurality of foam protective pads extending along each finger section, the foam protective pads within each finger pattern being aligned end-to-end and separated from adjacent foam protective pads by interstitial channels having a width within a range of from 1-4 mm, and a border flange circumscribing said adjacent finger sections of said dorsal panel, said border flange protruding outward from said zero-elevation surface around said adjacent finger sections, and protruding outward at an acute bevel angle relative to said zero-elevation surface around at least four adjacent finger sections, wherein the palmar section is stitched to said border flange surrounding at least two of said adjacent finger sections.

17. A protective sports glove having a palmar section configured for covering a wearer's palm, the protective sports glove comprising:

a unitary dorsal panel configured to be stitched to the palmar section, the dorsal panel consisting of an integrally molded panel formed with a main section having a zero-elevation surface and a waffle-pattern array of foam protective pads defined as individual islands raised from said zero-elevation surface, wherein adjacent foam protective pads are separated from each other by an interstitial channel, said dorsal panel further comprising, a main section, five finger sections each protruding from said main section, and a substantially contiguous border flange surrounding and projecting outward around the entire unitary dorsal panel inclusive of said main section and each of said five finger sections, said border flange protruding from said zero-elevation surface at an acute bevel angle relative thereto around at least two adjacent finger sections.

18. The protective sports glove according to claim 17, wherein said at least two adjacent finger sections is five finger sections.

19. A protective sports glove having a palmar section configured for covering a wearer's palm, the protective sports glove comprising:

a unitary dorsal panel configured to be stitched to the palmar section, the dorsal panel consisting of an integrally molded panel formed with a main section having a zero-elevation surface and a waffle-pattern array of foam protective pads defined as individual islands raised from said zero-elevation surface, wherein two or more of said foam protective pads are separated from each other by an interstitial channel, said dorsal panel further comprising at least four finger sections each protruding from said main section; and a substantially contiguous border flange edge surrounding the majority of the unitary dorsal panel inclusive of said main section and each of said at least four finger sections of said unitary dorsal panel and projecting outward beyond said waffle-pattern array of foam pads, wherein said border flange edge along a portion of said at least four finger sections comprises one or more slits therebetween for added flexibility, and said border flange edge is beveled by an inclined surface sloping away from said zero-elevation surface around at least two adjacent finger sections.

* * * * *